US006537159B2

(12) United States Patent
Ogg

(10) Patent No.: US 6,537,159 B2
(45) **Date of Patent: *Mar. 25, 2003**

(54) AERODYNAMIC PATTERN FOR A GOLF BALL

(75) Inventor: Steven S. Ogg, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/843,338

(22) Filed: Apr. 25, 2001

(65) Prior Publication Data

US 2001/0034273 A1 Oct. 25, 2001

Related U.S. Application Data

(63) Continuation-in-part of application No. 09/398,919, filed on Sep. 16, 1999, now Pat. No. 6,224,499.

(51) Int. Cl.[7] ..... A63B 37/14
(52) U.S. Cl. ..... 473/383
(58) Field of Search ..... 473/378–384

(56) References Cited

U.S. PATENT DOCUMENTS

| | | | | |
|---|---|---|---|---|
| 3,034,791 | A | | 5/1962 | Gallager |
| 3,940,145 | A | | 2/1976 | Gentiluomo |
| 3,989,568 | A | | 11/1976 | Isaac |
| 4,123,061 | A | | 10/1978 | Dusbiber |
| 4,560,168 | A | | 12/1985 | Aoyama |
| 4,762,326 | A | | 8/1988 | Gobush |
| 4,813,677 | A | | 3/1989 | Oka |
| 4,840,381 | A | | 6/1989 | Ihara |
| 4,880,241 | A | | 11/1989 | Melvin |
| 4,949,976 | A | | 8/1990 | Gobush |
| 4,979,747 | A | | 12/1990 | Jonkouski |
| 5,060,954 | A | | 10/1991 | Gobush |
| 5,106,887 | A | | 4/1992 | Jonkouski |
| 5,158,300 | A | | 10/1992 | Aoyama |
| 5,201,522 | A | | 4/1993 | Pocklington |
| 5,421,580 | A | | 6/1995 | Sugimoto |
| 5,566,943 | A | | 10/1996 | Boehm |
| 5,692,974 | A | | 12/1997 | Wu |
| 5,720,676 | A | | 2/1998 | Shimosaka |
| 5,735,757 | A | | 4/1998 | Moriyama |
| 5,752,889 | A | | 5/1998 | Yamagishi |
| 5,846,141 | A | * | 12/1998 | Morgan et al. ..... 473/377 |
| 5,857,924 | A | | 1/1999 | Miyagawa |
| 5,885,172 | A | | 3/1999 | Hebert |
| 5,906,551 | A | | 5/1999 | Kasashima |
| 5,935,023 | A | | 8/1999 | Maehara |
| 5,957,786 | A | | 9/1999 | Aoyama |
| 6,039,660 | A | | 3/2000 | Kasashima |
| 6,053,820 | A | | 5/2000 | Kasashima |
| 6,213,898 | B1 | * | 4/2001 | Ogg ..... 473/383 |
| 6,224,499 | B1 | * | 5/2001 | Ogg ..... 473/383 |
| 6,299,552 | B1 | * | 10/2001 | Morgan et al. ..... 473/384 |
| 6,331,150 | B1 | * | 12/2001 | Ogg ..... 473/383 |

* cited by examiner

*Primary Examiner*—Mark S. Graham
*Assistant Examiner*—Raeann Gordon
(74) *Attorney, Agent, or Firm*—Michael A. Catania

(57) ABSTRACT

A dimple pattern for a golf ball with multiple sets of dimples is disclosed herein. Each of the multiple sets of dimples has a different entry radius. A preferred set of dimples is eighteen different dimples. The dimples may cover as much as eighty-seven percent of the surface of the golf ball. The unique dimple pattern allows a golf ball to have shallow dimples with steeper entry angles. In a preferred embodiment, the golf ball has 382 dimples with eleven different diameters and eighteen different entry radii.

15 Claims, 8 Drawing Sheets

AERODYNAMIC PATTERN FOR A GOLF BALL

CROSS REFERENCES TO RELATED APPLICATIONS

This application is a continuation-in-part application of U.S. patent application Ser. No. 09/398,919 filed on Sep. 16, 1999, now U.S. Pat. No. 6,224,499.

STATEMENT REGARDING FEDERALLY SPONSORED RESEARCH OR DEVELOPMENT

Not Applicable

BACKGROUND OF THE INVENTION

1. Field of the Invention

The present invention relates to a golf ball. More specifically, the present invention relates to a dimple pattern for a golf ball in which the dimple pattern has different sizes of dimples.

2. Description of the Related Art

Golfers realized perhaps as early as the 1800's that golf balls with indented surfaces flew better than those with smooth surfaces. Hand-hammered gutta-percha golf balls could be purchased at least by the 1860's, and golf balls with brambles (bumps rather than dents) were in style from the late 1800's to 1908. In 1908, an Englishman, William Taylor, received a patent for a golf ball with indentations (dimples) that flew better and more accurately than golf balls with brambles. A.G. Spalding & Bros., purchased the U.S. rights to the patent and introduced the GLORY ball featuring the TAYLOR dimples. Until the 1970s, the GLORY ball, and most other golf balls with dimples had 336 dimples of the same size using the same pattern, the ATTI pattern. The ATTI pattern was an octahedron pattern, split into eight concentric straight line rows, which was named after the main producer of molds for golf balls.

The only innovation related to the surface of a golf ball during this sixty year period came from Albert Penfold who invented a mesh-pattern golf ball for Dunlop. This pattern was invented in 1912 and was accepted until the 1930's.

In the 1970's, dimple pattern innovations appeared from the major golf ball manufacturers. In 1973, Titleist introduced an icosahedron pattern which divides the golf ball into twenty triangular regions. An icosahedron pattern was disclosed in British Patent Number 377,354 to John Vernon Pugh, however, this pattern had dimples lying on the equator of the golf ball which is typically the parting line of the mold for the golf ball. Nevertheless, the icosahedron pattern has become the dominant pattern on golf balls today.

In the late 1970s and the 1980's the mathematicians of the major golf ball manufacturers focused their intention on increasing the dimpled surface area (the area covered by dimples) of a golf ball. The dimpled surface for the ATTI pattern golf balls was approximately 50%. In the 1970's, the dimpled surface area increased to greater than 60% of the surface of a golf ball. Further breakthroughs increased the dimpled surface area to over 70%. U.S. Pat. No. 4,949,976 to William Gobush discloses a golf ball with 78% dimple coverage with up to 422 dimples. The 1990's have seen the dimple surface area break into the 80% coverage.

The number of different dimples on a golf ball surface has also increased with the surface area coverage. The ATTI pattern disclosed a dimple pattern with only one size of dimple. The number of different types of dimples increased, with three different types of dimples becoming the preferred number of different types of dimples. U.S. Pat. No. 4,813,677 to Oka et al., discloses a dimple pattern with four different types of dimples on the surface where the non-dimpled surface cannot contain an additional dimple. United Kingdom patent application number 2157959, to Steven Aoyama, discloses dimples with five different diameters. Further, William Gobush invented a cuboctahedron pattern that has dimples with eleven different diameters. See 500 *Year of Golf Balls,* Antique Trade Books, page 189. However, inventing dimple patterns with multiple dimples for a golf ball only has value if such a golf ball is commercialized and available for the typical golfer to play.

Additionally, dimple patterns have been based on the sectional shapes, such as octahedron, dodecahedron and icosahedron patterns. U.S. Pat. No. 5,201,522 discloses a golf ball dimple pattern having pentagonal formations with an equal number of dimples thereon. U.S. Pat. No. 4,880,241 discloses a golf ball dimple pattern having a modified icosahedron pattern wherein small triangular sections lie along the equator to provide a dimple-free equator.

Although there are hundreds of published patents related to golf ball dimple patterns, there still remains a need to improve upon current dimple patterns. This need is driven by new materials used to manufacture golf balls, and the ever increasing innovations in golf clubs.

BRIEF SUMMARY OF THE INVENTION

The present invention provides a novel dimple pattern that reduces high speed drag on a golf ball while increasing its low speed lift thereby providing a golf ball that travels greater distances. The present invention is able to accomplish this by providing multiples sets of dimples arranged in a pattern that covers as much as eighty-six percent of the surface of the golf ball.

One aspect of the present invention is a dimple pattern on a golf ball in which the dimple pattern has at least eighteen different sets of dimples. Each of the eighteen different sets of dimples has a different entry radius than any other set of dimples. The dimples cover at least 87% of the surface of the golf ball.

Another aspect of the present invention is a golf ball having at least 382 dimples. The 382 dimples are partitioned into at least eleven different sets of dimples. Each of the eleven different sets of dimples has a different diameter than any other set of dimples. The 382 dimples cover at least 87% of the surface of the golf ball.

Yet another aspect of the present invention is a golf ball having a core and cover. The core has a diameter of 1.50 inches to 1.56 inches, and is composed of a polybutadiene material. The cover encompasses the core and has a thickness of 0.05 inch to 0.10 inch. The cover is preferably composed of an ionomer blend of material. The cover has a surface which has 382 dimples. The 382 dimples are partitioned into at least eleven different sets of dimples. Each of the eleven different sets of dimples have a different diameter than any other set of dimples. The 382 dimples cover at least 87% of the surface of the cover.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
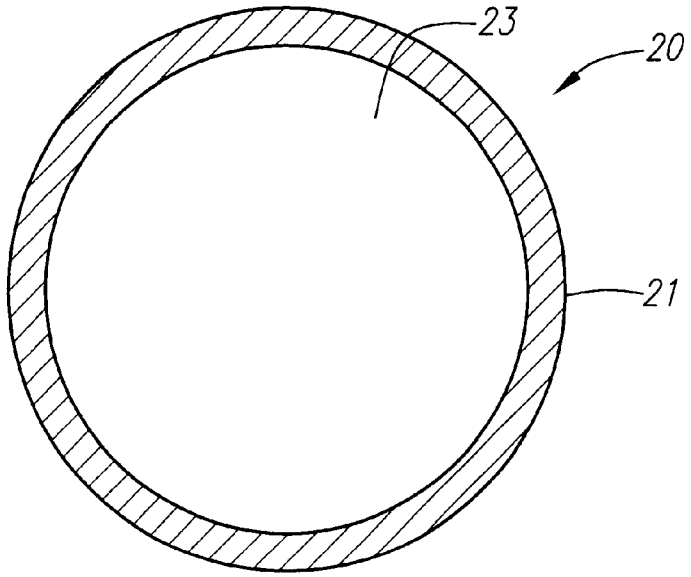
FIG. 1 is a cross-sectional view of a two-piece golf ball of the present invention.
Figure 1A:
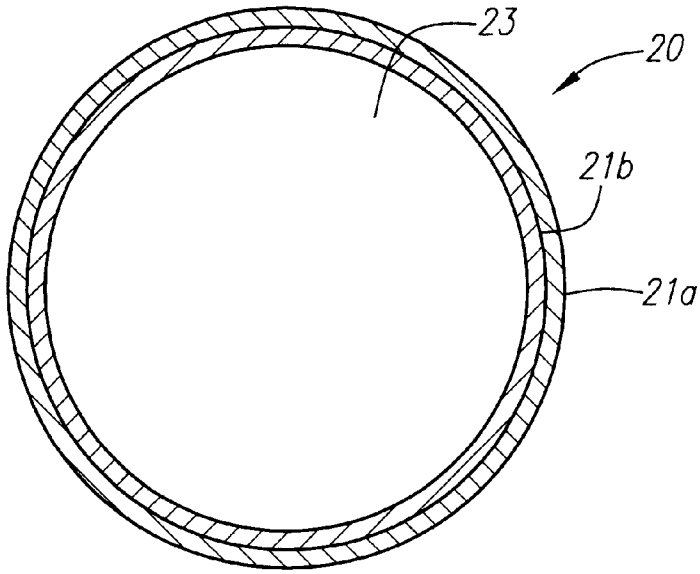
FIG. 1A is a cross-sectional view of a three-piece golf ball of the present invention.

As shown in FIG. 1, a golf ball is generally designated 20. The golf ball 20 is preferably a two-piece with a solid core and a cover such as disclosed in co-pending U.S. patent application Ser. No. 09/768,846, for a Golf Ball, filed on Jan. 23, 2001, and hereby incorporated by reference. Alternatively, the golf ball 20 is a three-piece golf ball as shown in FIG. 1A. Such a three-piece golf ball 20 is disclosed in U.S. Pat. No. 6,117,024, which is hereby incorporated by reference. However, those skilled in the pertinent art will recognize that the aerodynamic pattern of the present invention may by utilized on other two-piece or three-piece golf balls, one-piece golf balls, or multiple-layer golf balls without departing from the scope and spirit of the present invention.

A cover 21 or 21*a* of the golf ball 20 may be any suitable material. A preferred cover 21 is composed of a thermoplastic material such as an ionomer material or a thermosetting material such as a polyurethane. However, those skilled in the pertinent art will recognize that other cover materials may be utilized without departing from the scope and spirit of the present invention. If the golf ball is a three-piece golf ball 20, as shown in FIG. 1A, the intermediate layer 21*b* is preferably composed of an ionomer material while the cover 21*a* is composed of a softer material. The golf ball 20 may have a finish of a basecoat and/or top coat with a logo indicia. A core 23 of the golf ball is preferably composed of a polybutadiene material.

Figure 2:
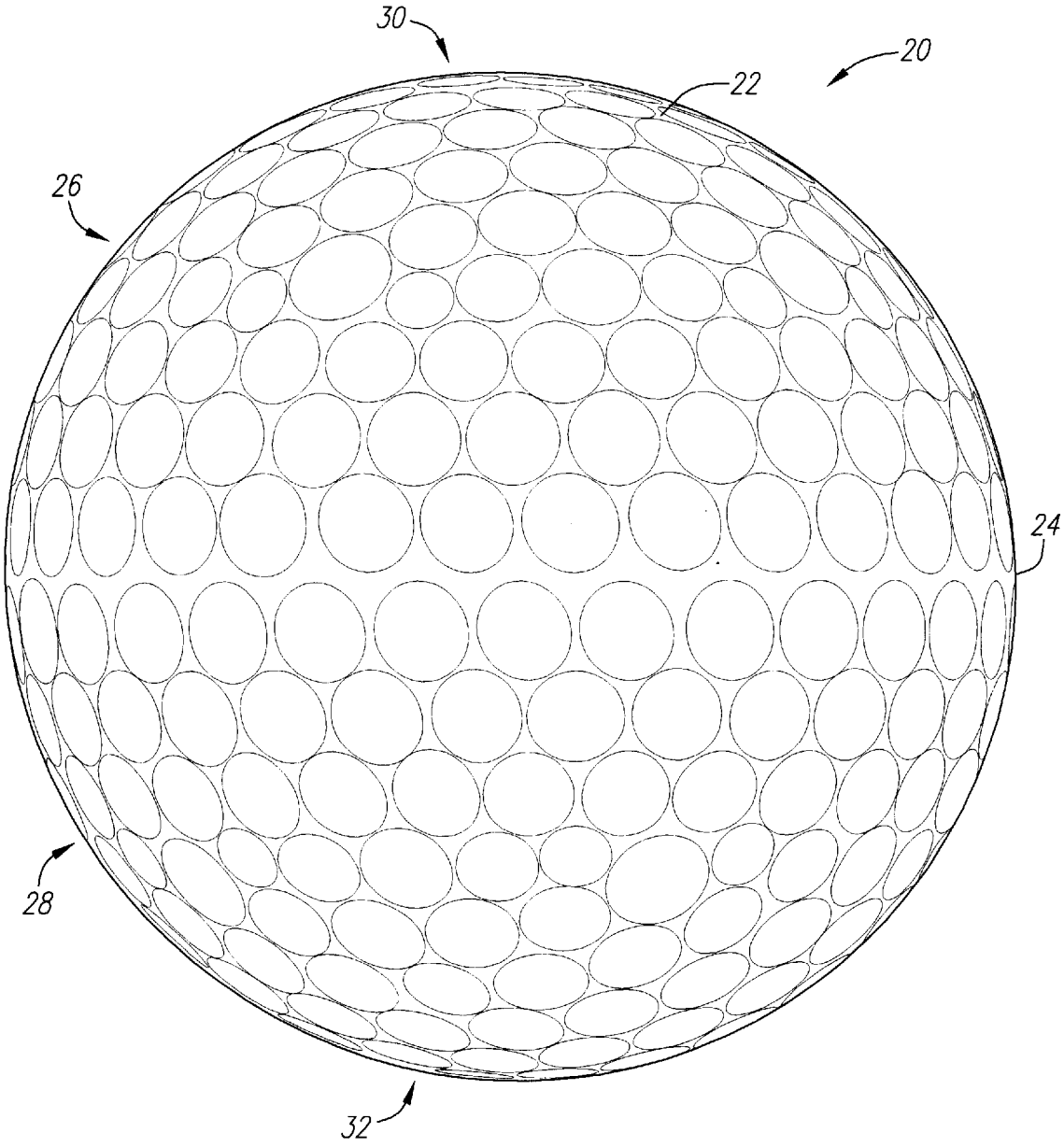
FIG. 2 is an equatorial view of a preferred embodiment of a golf ball of the present invention.
Figure 3:
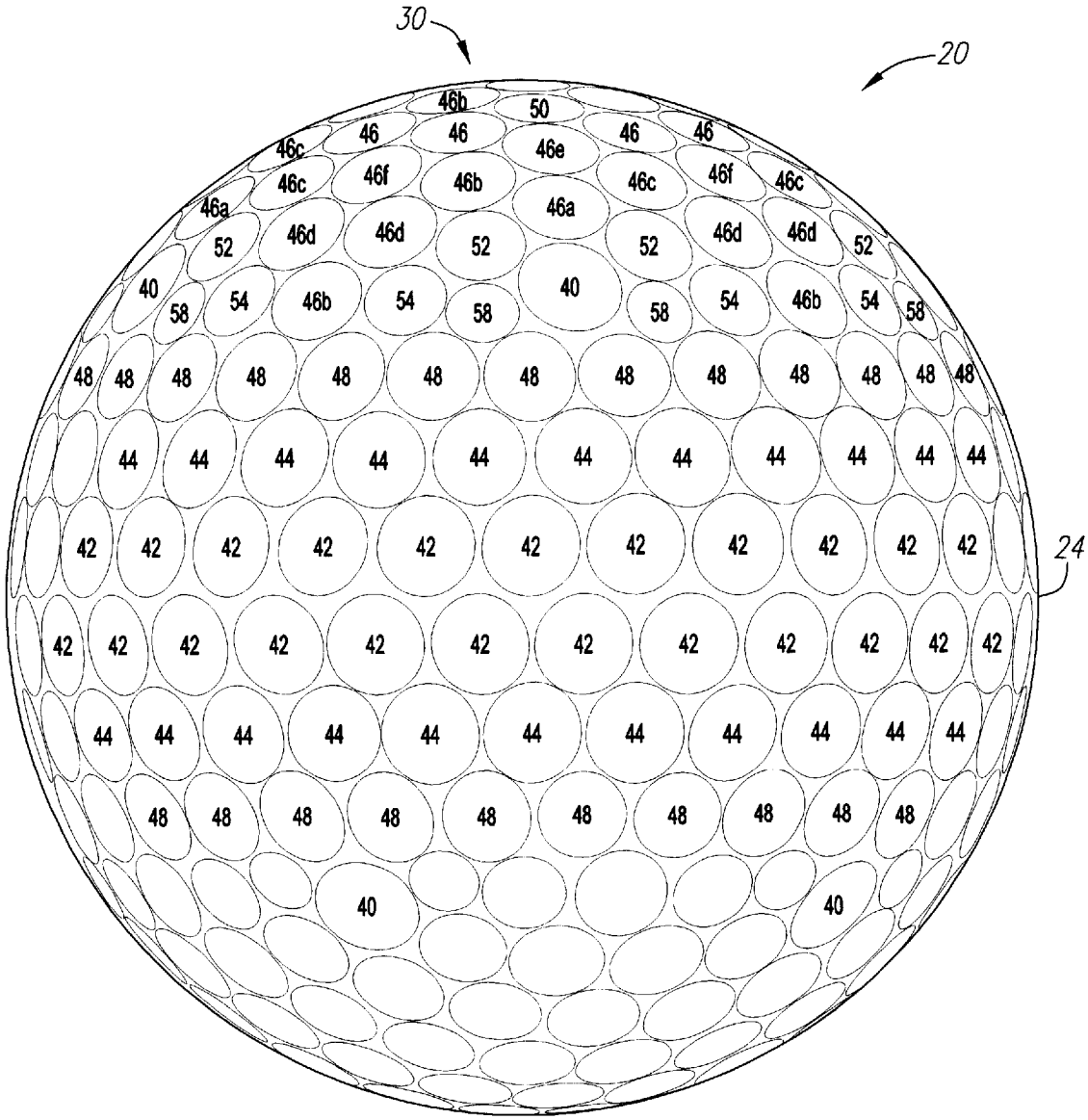
FIG. 3 is an equatorial view of a preferred embodiment of a golf ball of the present invention.
Figure 4:
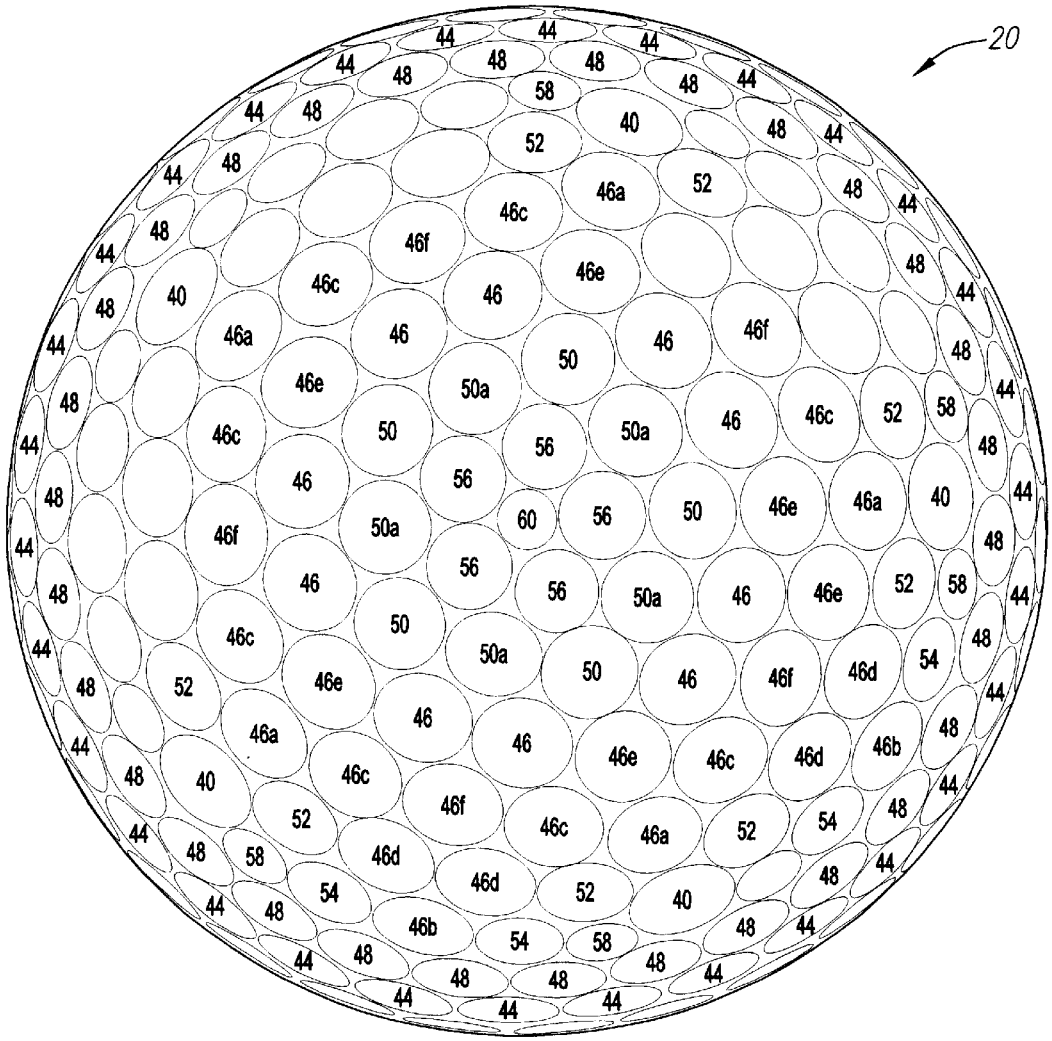
FIG. 4 is a polar view of the golf ball of FIG. 1.

As shown in FIGS. 2–4, the golf ball 20 has a surface 22. The golf ball 20 also has an equator 24 dividing the golf ball 20 into a first hemisphere 26 and a second hemisphere 28. A first pole 30 is located ninety degrees along a longitudinal arc from the equator 24 in the first hemisphere 26. A second pole 32 is located ninety degrees along a longitudinal arc from the equator 24 in the second hemisphere 28.

On the surface 22, in both hemispheres 26 and 28, are a plurality of dimples partitioned into multiple different sets of dimples. In a preferred embodiment, the number of dimples is 382, and there are eleven different sets of dimples, as partitioned by diameter of the dimple. Sets of dimples also vary by entry radius, entry angle and chord depth. In an alternative embodiment, there are eighteen different sets of dimples by entry radius.

In a preferred embodiment, there is a first plurality of dimples 40, a second plurality of dimples 42, a third plurality of dimples 44, a fourth plurality of dimples 46 (including 46*a*–46*f*), a fifth plurality of dimples 48, a sixth plurality of dimples 50 (including 50*a*), a seventh plurality of dimples 52, an eighth plurality of dimples 54, a ninth plurality of dimples 56, a tenth plurality of dimples 58, and an eleventh plurality of dimples 60.

In the preferred embodiment, each of the first plurality of dimples 40 has the largest diameter dimple, and each of the eleventh plurality of dimples 60 has the smallest diameter dimples. The diameter of a dimple is measured from a surface inflection point 100 across the center of the dimple to an opposite surface inflection point 100. The surface inflection points 100 are where the land surface 22 ends and where the dimples begin. Each of the second plurality of dimples 42 has a smaller diameter than the diameter of each of the first plurality of dimples 40. Each of the third plurality of dimples 44 has a smaller diameter than the diameter of each of the second plurality of dimples 42. Each of the fourth plurality of dimples 46 (including 46*a*–46*f*) has a smaller diameter than the diameter of each of the third plurality of dimples 44. Each of the fifth plurality of dimples 48 has a diameter that is equal to or smaller than the diameter of each of the fourth plurality of dimples 46. Each of the sixth plurality of dimples 50 (including 50*a*) has a smaller diameter than the diameter of each of the fifth plurality of dimples 48. Each of the seventh plurality of dimples 52 has a smaller diameter than the diameter of each of the sixth plurality of dimples 50. Each of the eighth plurality of dimples 54 has a smaller diameter than the diameter of each of the seventh plurality of dimples 52. Each of the ninth plurality of dimples 56 has a smaller diameter than the diameter of each of the eighth plurality of dimples 54. Each of the tenth plurality of dimples 58 has a smaller diameter than the diameter of each of the ninth plurality of dimples 56. Each of the eleventh plurality of dimples 60 has a smaller diameter than the diameter of each of the tenth plurality of dimples 58.

In a preferred embodiment, the fourth plurality of dimples 46 (including 46*a*–46*f*) are the most numerous. The second plurality of dimples 42, the third plurality of dimples 44, and the fifth plurality of dimples 48 are equally the second most numerous. The eleventh plurality of dimples 60 is the least.

Table One provides a description of the preferred embodiment. Table One includes the dimple diameter (in inches from inflection point to inflection point), chord depth (in inches measured from the inflection point to the bottom of the dimple at the center), entry angle for each dimple, entry radius for each dimple (in inches) and number of dimples.

TABLE ONE

| Dimple Reference | # of Dimples | Dimple Diameter | Chord Depth | Entry Angle | Entry Radius |
|---|---|---|---|---|---|
| 40 | 10 | 0.1838 | 0.0056 | 15.01 | 0.0385 |
| 42 | 60 | 0.1678 | 0.0054 | 13.37 | 0.0351 |

TABLE ONE-continued

| Dimple Reference | # of Dimples | Dimple Diameter | Chord Depth | Entry Angle | Entry Radius |
|---|---|---|---|---|---|
| 44 | 60 | 0.1668 | 0.0056 | 14.09 | 0.0338 |
| 46 | 20 | 0.1648 | 0.0054 | 14.85 | 0.0332 |
| 46a | 10 | 0.1648 | 0.0056 | 15.33 | 0.0375 |
| 46b | 10 | 0.1648 | 0.0054 | 14.56 | 0.0365 |
| 46c | 20 | 0.1648 | 0.0056 | 14.71 | 0.0343 |
| 46d | 20 | 0.1648 | 0.0057 | 14.44 | 0.0340 |
| 46e | 10 | 0.1648 | 0.0054 | 14.77 | 0.0321 |
| 46f | 10 | 0.1648 | 0.0056 | 14.35 | 0.0320 |
| 48 | 60 | 0.159 | 0.0059 | 14.85 | 0.0314 |
| 50 | 10 | 0.1586 | 0.0054 | 15.27 | 0.0258 |
| 50a | 10 | 0.1586 | 0.0052 | 14.69 | 0.0376 |
| 52 | 20 | 0.156 | 0.0055 | 14.73 | 0.0428 |
| 54 | 20 | 0.1462 | 0.0055 | 13.80 | 0.0364 |
| 56 | 10 | 0.1422 | 0.0054 | 14.12 | 0.0293 |
| 58 | 20 | 0.1224 | 0.0054 | 15.14 | 0.0295 |
| 60 | 2 | 0.1008 | 0.0057 | 20.35 | 0.0270 |

The two dimples of the eleventh set of dimples 60 are each disposed on respective poles 30 and 32. Each of the ninth set of dimples 56 is adjacent one of the eleventh set of dimples 60. The five dimples of the ninth set of dimples 56 that are disposed within the first hemisphere 26 are each an equal distance from the equator 24 and the first pole 30. The five dimples of the ninth set of dimples 56 that are disposed within the second hemisphere 28 are each an equal distance from the equator 24 and the second pole 32. These polar dimples 60 and 56 account for approximately 2% of the surface area of the golf ball 20.

Figure 5:
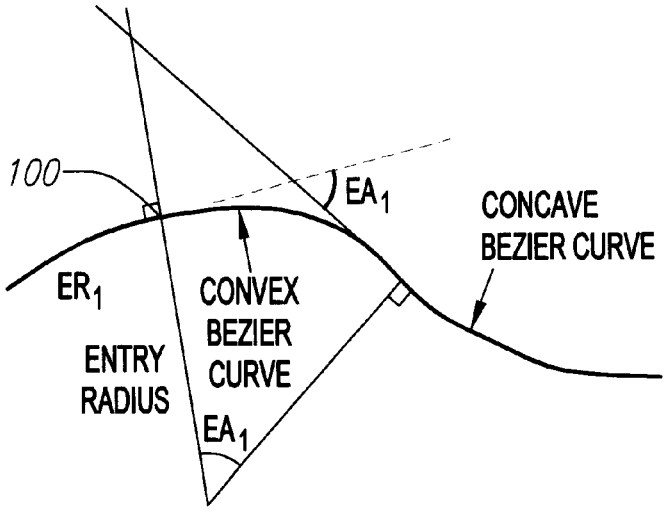
FIG. 5 is an isolated partial cross-sectional view of a dimple to illustrate the definition of the entry radius.

Unlike the use of the term "entry radius" or "edge radius" in the prior art, the edge radius as defined herein is a value utilized in conjunction with the entry angle to delimit the concave and convex segments of the dimple contour. The first and second derivatives of the two Bézier curves are forced to be equal at this point defined by the edge radius and the entry angle, as shown in FIG. 5A. A more detailed description of the contour of the dimples is set forth in U.S. Pat. No. 6,331,150, filed on Sep. 16, 1999, entitled Golf Ball Dimples With Curvature Continuity, which is hereby incorporated by reference in its entirety.

Figure 6:
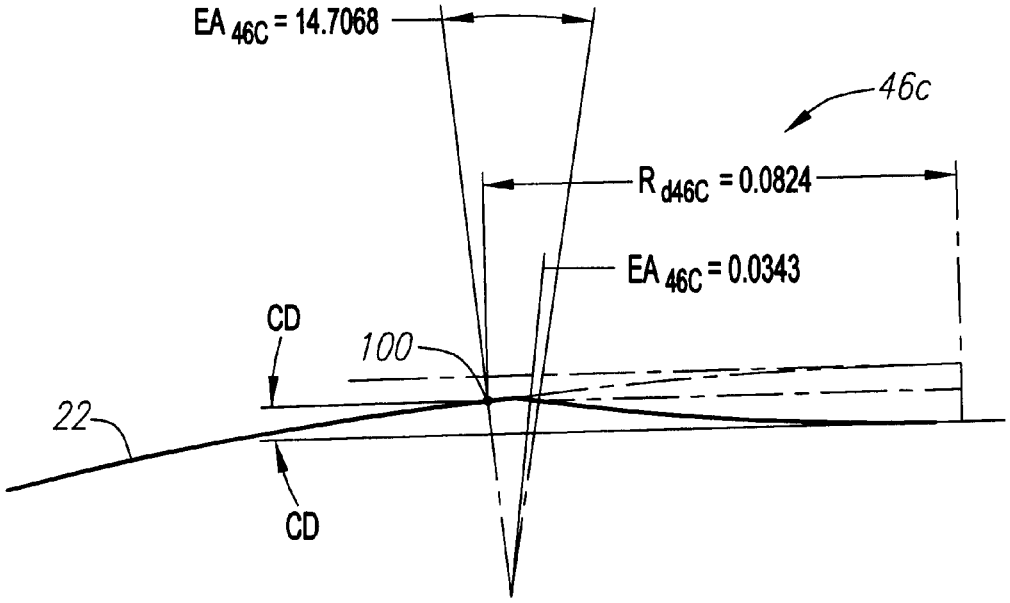
FIG. 6 is an enlarged half cross-sectional view of a typical dimple of a fourth set of dimples of the golf ball of the present invention.

FIGS. 6–10 illustrate the half cross-sectional views of dimples for some of the different sets of dimples. A half cross-sectional view of a typical dimple of the fourth set of dimples 46*c* is shown in FIG. 6. The radius $R_{d46c}$ of the dimple 46*c is approximately* 0.0824 inch, the chord depth CD—CD is approximately 0.0056 inch, the entry angle $EA_{46c}$ is approximately 14.7068 degrees, and the entry radius $ER_{46c}$ is approximately 0.0343 inch.

Figure 7:
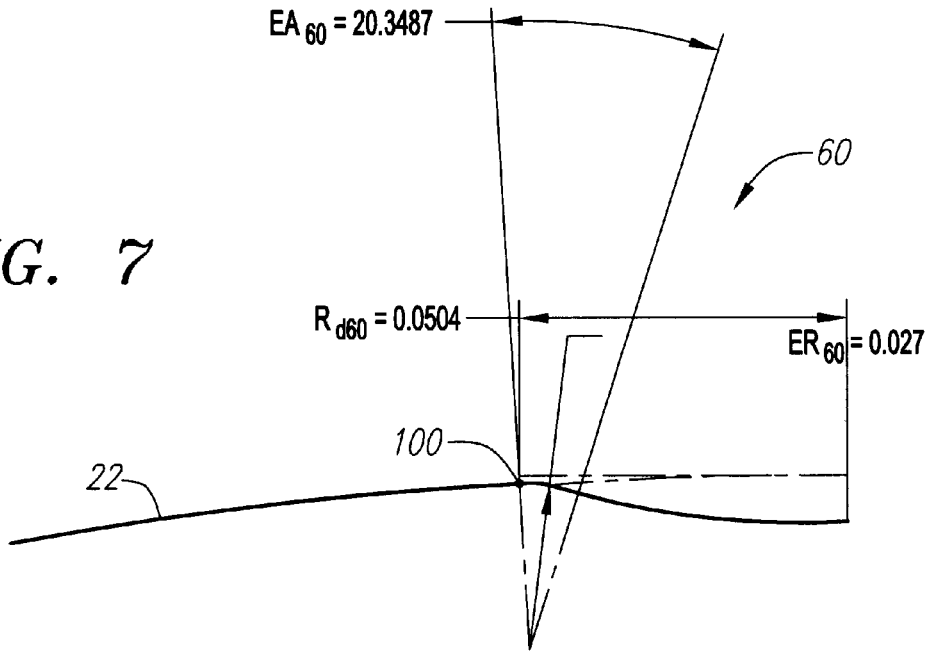
FIG. 7 is an enlarged half cross-sectional view of a dimple of a eleventh set of dimples of the golf ball of the present invention.

A half cross-sectional view of a dimple of the eleventh set of dimples 60 is shown in FIG. 7. The dimple radius $R_{d60}$ of the dimple 60 is approximately 0.0504 inch, the entry angle $EA_{60}$ is approximately 20.3487 degrees, and the entry radius $ER_{60}$ is approximately 0.027 inch. The entry angle for each of the two dimples 60 of the eleventh set of dimples is the largest entry angle for a dimple in the preferred embodiment.

Figure 8:
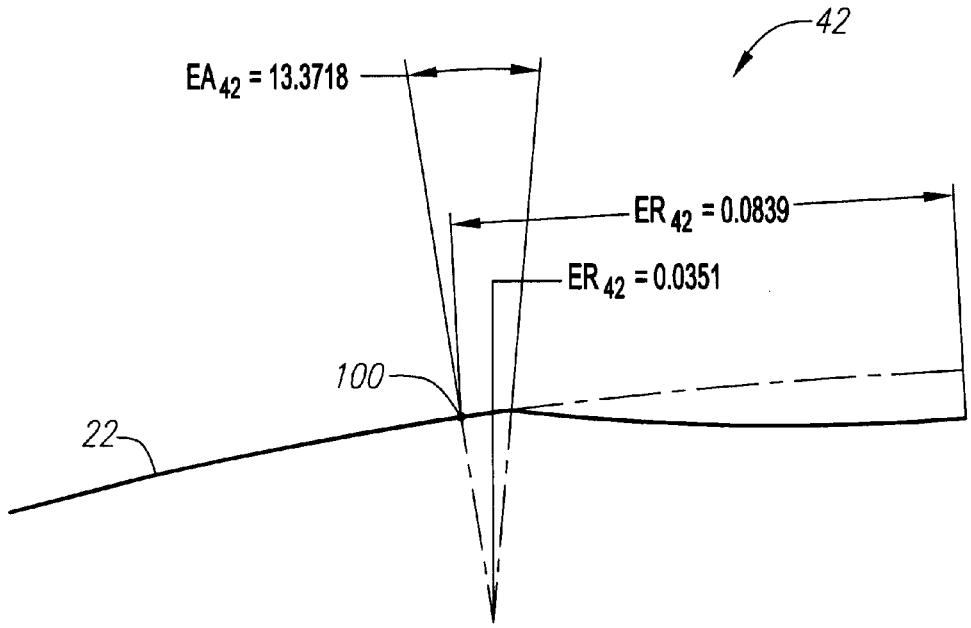
FIG. 8 is an enlarged half cross-sectional view of a dimple of a second set of dimples of the golf ball of the present invention.

A half cross-sectional view of a dimple of the second set of dimples 42 is shown in FIG. 8. The dimple radius $R_{d42}$ of the dimple 42 is approximately 0.0839 inch, the entry angle $EA_{42}$ is approximately 13.3718 degrees, and the entry radius $ER_{42}$ is approximately 0.0351 inch. The entry angle for each of the sixty dimples 42 of the second set of dimples is the smallest entry angle for a dimple in the preferred embodiment.

Figure 9:
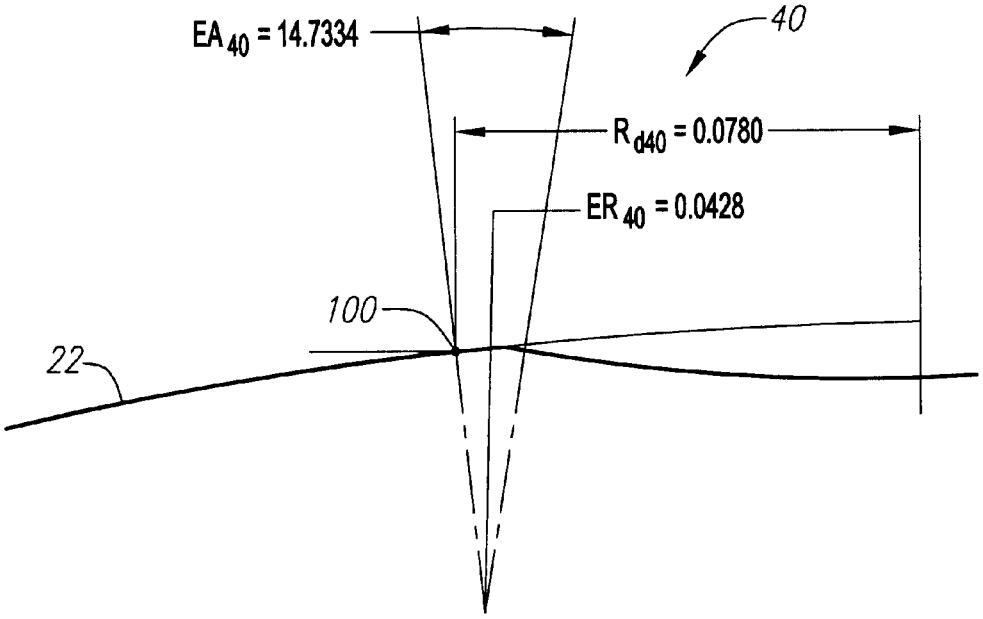
FIG. 9 is an enlarged half cross-sectional view of a dimple of a first set of dimples of the golf ball of the present invention.

A half cross-sectional view of a dimple of the seventh set of dimples 52 is shown in FIG. 9. The dimple radius $R_{52}$ of the dimple 52 is approximately 0.0780 inch, the entry angle $EA_{52}$ is approximately 14.7334 degrees, and the entry radius $ER_{52}$ is approximately 0.0428 inch. The entry radius for each of the twenty dimples 52 of the seventh set of dimples is the largest entry radius for a dimple in the preferred embodiment. The ten dimples of the seventh set of dimples 52 that are disposed within the first hemisphere 26 are each an equal distance from the equator 24 and the first pole 30. The ten dimples of the seventh set of dimples 52 that are disposed within the second hemisphere 28 are each an equal distance from the equator 24 and the second pole 32.

Figure 10:
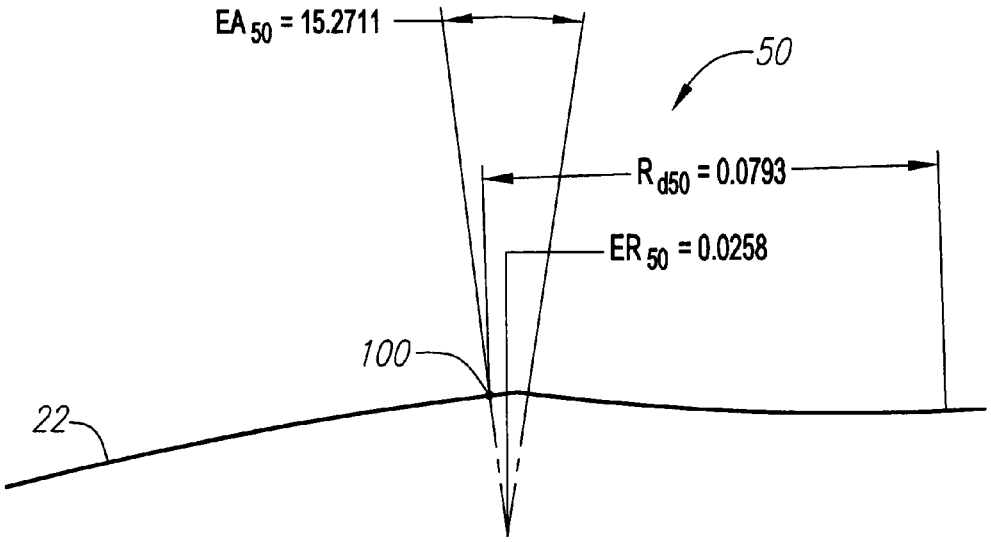
FIG. 10 is an enlarged half cross-sectional view of a typical dimple of a sixth set of dimples of the golf ball of the present invention.

A half cross-sectional view of a dimple of the sixth set of dimples 50 is shown in FIG. 10. The dimple radius $R_{d50}$ of the dimple 50 is approximately 0.0793 inch, the entry angle $EA_{50}$ is approximately 15.2711 degrees, and the entry radius $ER_{50}$ is approximately 0.0258 inch. The entry radius for each of the ten dimples 50 of the seventh set of dimples is the smallest entry radius for a dimple in the preferred embodiment.

Alternative embodiments of the dimple pattern of the present invention may vary in the number of dimples, diameters, depths, entry angle and/or entry radius. Most common alternatives will not have any dimples at the poles 30 and 32. Other common alternatives will have the same number of dimples, but with less variation in the diameters.

The force acting on a golf ball in flight is calculated by the following trajectory equation:

$$F=F_L+F_D+G \tag{A}$$

wherein F is the force acting on the golf ball; $F_L$ is the lift; $F_D$ is the drag; and G is gravity. The lift and the drag in equation A are calculated by the following equations:

$$F_L=0.5C_LA\rho v^2 \tag{B}$$

$$F_D=0.5C_DA\rho v^2 \tag{C}$$

wherein $C_L$ is the lift coefficient; $C_D$ is the drag coefficient; A is the maximum cross-sectional area of the golf ball; ρ is the density of the air; and v is the golf ball airspeed.

The drag coefficient, $C_D$, and the lift coefficient, $C_L$, may be calculated using the following equations:

$$C_{D-2}F_D/A\rho v^2 \tag{D}$$

$$C_{L-2}F_L/A\rho v^2 \tag{E}$$

The Reynolds number R is a dimensionless parameter that quantifies the ratio of inertial to viscous forces acting on an object moving in a fluid. Turbulent flow for a dimpled golf ball occurs when R is greater than 40000. If R is less than 40000, the flow may be laminar. The turbulent flow of air about a dimpled golf ball in flight allows it to travel farther than a smooth golf ball.

The Reynolds number R is calculated from the following equation:

$$R=vD\rho/\mu \tag{F}$$

wherein v is the average velocity of the golf ball; D is the diameter of the golf ball (usually 1.68 inches); ρ is the density of air (0.00238 slugs/ft$^3$ at standard atmospheric conditions); and $\mu$ is the absolute viscosity of air ($3.74\times10^{-7}$ lb*sec/ft$^2$ at standard atmospheric conditions). A Reynolds number, R, of 180,000 for a golf ball having a USGA approved diameter of 1.68 inches, at standard atmospheric conditions, approximately corresponds to a golf ball hit from the tee at 200 ft/s or 136 mph, which is the point in time during the flight of a golf ball when the golf ball attains its highest speed. A Reynolds number, R, of 70,000 for a golf ball having a USGA approved diameter of 1.68 inches, at standard atmospheric conditions, approximately corresponds to a golf ball at its apex in its flight, 78 ft/s or 53 mph, which is the point in time during the flight of the golf ball when the golf ball travels at its slowest speed. Gravity will increase the speed of a golf ball after its reaches its apex.

Figure 11:
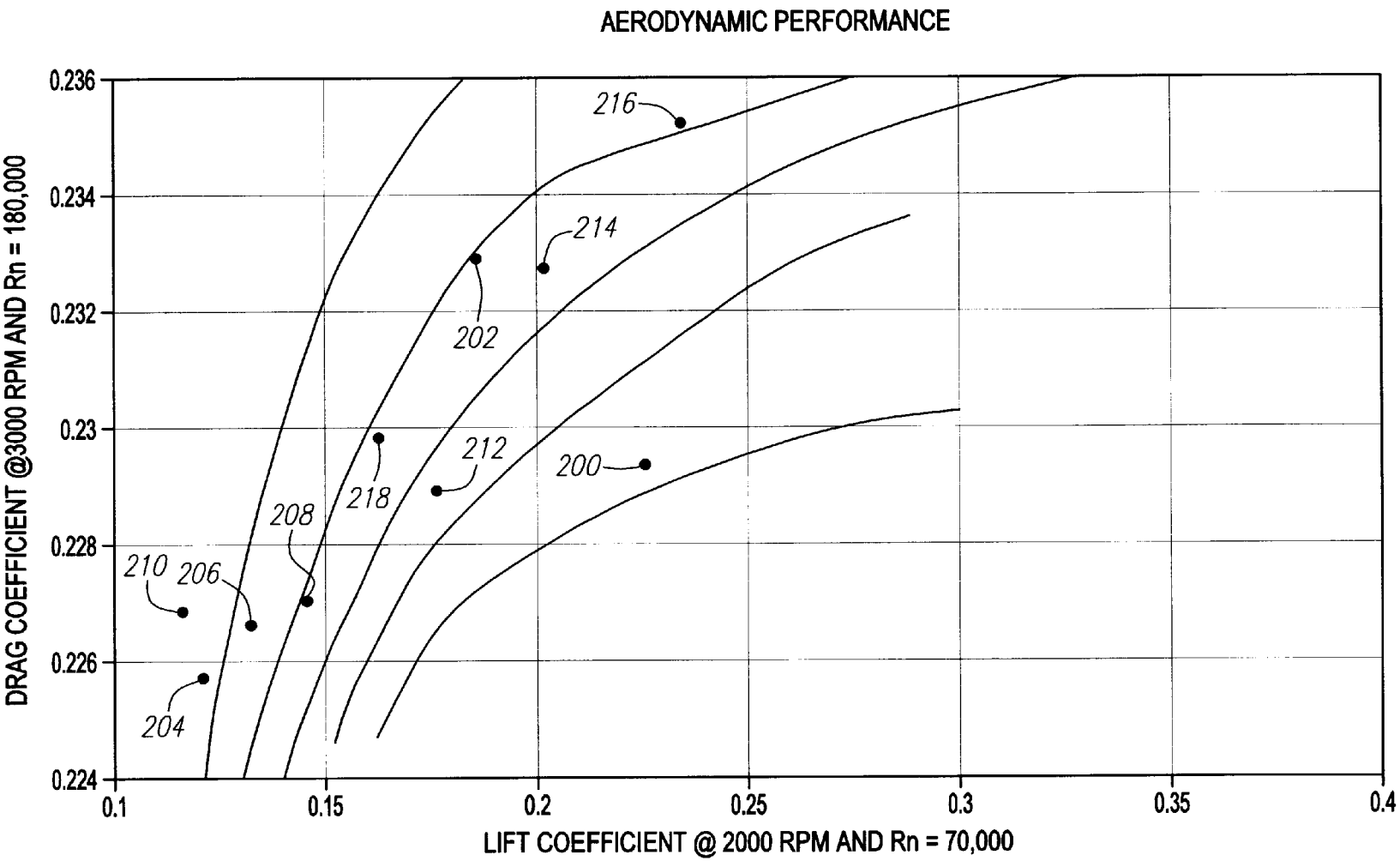
FIG. 11 is a graph of the lift coefficient for a Reynolds number of 70,000 at 2000 rotations per minute (x-axis) versus the drag coefficient for a Reynolds number of 180,000 at 3000 rotations per minute (y-axis).

FIG. 11 is a graph of the lift coefficient for a Reynolds number of 70,000 at 2000 rotations per minute versus the drag coefficient for a Reynolds number of 180,000 at 3000 rotations per minute for a golf ball 20 with the dimple pattern of the present invention thereon as compared to the Titlelist HP DISTANCE 202, the Titlelist HP ECLIPSE 204, the SRI Maxfli HI-BRD (from Japan) 206, the Wilson CYBERCORE PRO DISTANCE 208, the Titleist PRO V1 210, the Bridgestone TOUR STAGE MC392 (from Japan) 212, the Precept MC LADY 214, the Nike TOUR ACCURACY 216, and the Titlelist DT DISTANCE 218.

The golf balls 20 with the dimple pattern of the present invention were constructed as set forth in co-pending U.S. patent application Ser. No. 09/768,846, as previously referenced. The aerodynamics of the dimple pattern of the present invention provides a greater lift with a reduced drag thereby translating into a golf ball 20 that travels a greater distance than golf balls of similar constructions.

As compared to other golf balls, the golf ball 20 of the present invention is the only one that combines a lower drag coefficient at high speeds, and a greater lift coefficient at low speeds. Specifically, as shown in FIG. 11, none of the other golf balls have a lift coefficient, $C_L$, greater than 0.19 at a Reynolds number of 70,000, and a drag coefficient $C_D$ less than 0.232 at a Reynolds number of 180,000. For example, while the Nike TOUR ACCURACY 216 has a $C_L$ greater than 0.19 at a Reynolds number of 70,000, its $C_D$ is greater than 0.232 at a Reynolds number of 180,000. Also, while the Titleist DT DISTANCE 218 has a drag coefficient $C_D$ less than 0.232 at a Reynolds number of 180,000, its $C_L$ is less than 0.19 at a Reynolds number of 70,000. Further, the golf ball 20 of the present invention is the only golf ball that has a lift coefficient, $C_L$, greater than 0.20 at a Reynolds number of 70,000, and a drag coefficient $C_D$ less than 0.235 at a Reynolds number of 180,000. Yet further, the golf ball 20 of the present invention is the only golf ball that has a lift coefficient, $C_L$, greater than 0.19 at a Reynolds number of 70,000, and a drag coefficient $C_D$ less than 0.229 at a Reynolds number of 180,000. More specifically, the golf ball 20 of the present invention is the only golf ball that has a lift coefficient, $C_L$, greater than 0.21 at a Reynolds number of 70,000, and a drag coefficient CD less than 0.230 at a Reynolds number of 180,000. Even more specifically, the golf ball 20 of the present invention is the only golf ball that has a lift coefficient, $C_L$, greater than 0.22 at a Reynolds number of 70,000, and a drag coefficient $C_D$ less than 0.230 at a Reynolds number of 180,000.

In this regard, the Rules of Golf, approved by the United States Golf Association ("USGA") and The Royal and Ancient Golf Club of Saint Andrews, limits the initial velocity of a golf ball to 250 feet (76.2 m) per second (a two percent maximum tolerance allows for an initial velocity of 255 per second) and the overall distance to 280 yards (256 m) plus a six percent tolerance for a total distance of 296.8 yards (the six percent tolerance may be lowered to four percent). A complete description of the Rules of Golf are available on the USGA web page at www.usga.org. Thus, the initial velocity and overall distance of a golf ball must not exceed these limits in order to conform to the Rules of Golf. Therefore, the golf ball 20 has a dimple pattern that enables the golf ball 20 to meet, yet not exceed, these limits.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention:

1. A golf ball having a surface, the golf ball comprising:

a first plurality of dimples disposed on the surface, each of the first plurality of dimples having a first diameter;

a second plurality of dimples disposed on the surface, each of the second plurality of dimples having a second diameter, the second diameter less than the first diameter;

a third plurality of dimples disposed on the surface, each of the third plurality of dimples having a third diameter, the third diameter less than the second diameter;

a fourth plurality of dimples disposed on the surface, each of the fourth plurality of dimples having a fourth diameter, the fourth diameter less than the third diameter, wherein the fourth plurality of dimples is composed of seven different sets of dimples, each type having a different entry radius;

a fifth plurality of dimples disposed on the surface, each of the fifth plurality of dimples having a fifth diameter, the fifth diameter less than the fourth diameter;

a sixth plurality of dimples disposed on the surface, each of the sixth plurality of dimples having a sixth diameter, the sixth diameter less than the fifth diameter;

a seventh plurality of dimples disposed on the surface, each of the seventh plurality of dimples having a seventh diameter, the seventh diameter less than the sixth diameter;

a eighth plurality of dimples disposed on the surface, each of the eighth plurality of dimples having a eighth diameter, the eighth diameter less than the seventh diameter;

a ninth plurality of dimples disposed on the surface, each of the ninth plurality of dimples having a ninth diameter, the ninth diameter less than the eighth diameter;

a tenth plurality of dimples disposed on the surface, each of the tenth plurality of dimples having a tenth diameter, the tenth diameter less than the ninth diameter; and an eleventh plurality of dimples disposed on the surface, each of the eleventh plurality of dimples having a eleventh diameter, the eleventh diameter less than the tenth diameter;

wherein the first, second, third, fourth, fifth, sixth, seventh, eighth, ninth, tenth and eleventh pluralities of dimples cover at least 87% of the surface of the golf ball.

2. The golf ball according to claim 1 wherein the first, second, third, fourth, fifth, sixth, seventh, eighth, ninth, tenth and eleventh pluralities of dimples total 382 dimples.

3. The golf ball according to claim 2 wherein at least one of the first, second, third, fourth, fifth, sixth, seventh, eighth, ninth, tenth and eleventh pluralities of dimples comprises at least two different sets of dimples which vary in chord depth, entry radius or entry angle while having the same diameter.

4. The golf ball according to claim 1 wherein the golf ball has an equator that divides the golf ball into a first hemisphere and a second hemisphere, wherein the first hemisphere is unsymmetrical with the second hemisphere.

5. The golf ball according to claim 1 wherein the eleventh diameter is less than 0.124 inch and the first diameter is greater than 0.168 inch.

6. The golf ball according to claim 1 wherein ten dimples cover at least three percent of the surface of the golf ball.

7. The golf ball according to claim I wherein each of the first plurality of dimples disposed on a first hemisphere of the golf ball lies an equal distance from a first pole, and each of the first plurality of dimples disposed on a second hemisphere of the golf ball lies an equal distance from a second pole.

8. The golf ball according to claim 1 wherein the eleventh plurality of dimples is the least numerous.

9. A golf ball having a surface, the golf ball comprising:

at least 382 dimples, wherein the at least 382 dimples are partitioned into at least eighteen different sets of dimples, each of the eighteen different sets of dimples having a different entry radius than any other set of dimples, and wherein the at least 382 dimples cover at least 87% of the surface of the golf ball.

10. A golf ball comprising:

a core having a diameter of 1.50 inches to 1.56 inches;

a cover encompassing the core, the cover having a thickness of 0.05 inch to 0.10 inch, the cover having a surface, the surface comprising at least 382 dimples, wherein the at least 382 dimples are partitioned into at least eighteen different sets of dimples, each of the eighteen different sets of dimples having a different entry radius than any other set of dimples, and wherein the at least 382 dimples cover at least 87% of the surface of the cover.

11. The golf ball according to claim 10 wherein the core is composed of a polybutadiene material and the cover is composed of an ionomer blend material.

12. A golf ball having a surface, the golf ball comprising multiple sets of dimples wherein the golf ball has a lift coefficient greater than 0.19 at a Reynolds number of 70,000 and 2000 rpm, and a drag coefficient less than 0.230 at a Reynolds number of 180,000 and 3000 rpm.

13. The golf ball according to claim 12 wherein the multiple sets of dimples comprises at least eighteen sets of dimples, each of the sets of dimples having an entry radius that is different than any other set of dimples.

14. A golf ball having a surface, the golf ball comprising multiple sets of dimples wherein the golf ball has a lift coefficient greater than 0.20 at a Reynolds number of 70,000 and 2000 rpm, and a drag coefficient less than 0.235 at a Reynolds number of 180,000 and 3000 rpm.

15. A golf ball having a surface, the golf ball comprising multiple sets of dimples wherein the golf ball has a lift coefficient greater than 0.22 at a Reynolds number of 70,000 and 2000 rpm, and a drag coefficient less than 0.230 at a Reynolds number of 180,000 and 3000 rpm.

* * * * *